US009506316B2

(12) United States Patent
Carr et al.

(10) Patent No.: US 9,506,316 B2
(45) **Date of Patent: *Nov. 29, 2016**

(54) COMPOSITE SLIPS FOR A FRAC PLUG

(71) Applicant: DIAMONDBACK Industries, Inc., Crowley, TX (US)

(72) Inventors: Jimmy L Carr, Fort Worth, TX (US); Derrek D Drury, Fort Worth, TX (US); Robert C Andres, Fort Worth, TX (US); Trea H Baker, Granbury, TX (US)

(73) Assignee: DIAMONDBACK Industries, Inc., Crowley, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/543,687

(22) Filed: Nov. 17, 2014

(65) Prior Publication Data

US 2015/0068729 A1 Mar. 12, 2015

Related U.S. Application Data

(63) Continuation of application No. 13/288,014, filed on Nov. 2, 2011, now Pat. No. 8,887,818, and a continuation of application No. 14/537,865, filed on Nov. 10, 2014.

(51) Int. Cl.

| | |
|---|---|
| ***E21B 33/129*** | (2006.01) |
| ***E21B 33/134*** | (2006.01) |
| ***E21B 23/06*** | (2006.01) |
| ***E21B 33/128*** | (2006.01) |
| *E21B 23/00* | (2006.01) |
| *E21B 23/01* | (2006.01) |
| *E21B 33/12* | (2006.01) |
| *E21B 43/26* | (2006.01) |
| *E21B 43/12* | (2006.01) |
| *E21B 43/14* | (2006.01) |

(52) U.S. Cl.

CPC ..... *E21B 33/1293* (2013.01); *E21B 23/06* (2013.01); *E21B 33/1204* (2013.01); *E21B 33/128* (2013.01); *E21B 33/134* (2013.01); *E21B 23/00* (2013.01); *E21B 23/01* (2013.01); *E21B 33/12* (2013.01); *E21B 33/1208* (2013.01); *E21B 33/129* (2013.01); *E21B 43/126* (2013.01); *E21B 43/14* (2013.01); *E21B 43/26* (2013.01)

(58) Field of Classification Search

CPC .. E21B 23/01; E21B 33/1204; E21B 33/129; E21B 33/1293

USPC ..... 166/192, 387, 118

See application file for complete search history.

(56) References Cited

U.S. PATENT DOCUMENTS

| | | | | |
|---|---|---|---|---|
| 2,426,370 | A * | 8/1947 | Penick | 277/339 |
| 3,109,493 | A * | 11/1963 | Carter | 277/337 |
| 6,564,870 | B1 * | 5/2003 | Grigsby et al. | 166/313 |
| 2011/0277989 | A1 * | 11/2011 | Frazier | 166/193 |
| 2012/0125637 | A1 * | 5/2012 | Chenault et al. | 166/382 |

* cited by examiner

*Primary Examiner* — Jennifer H Gay
*Assistant Examiner* — George Gray
(74) *Attorney, Agent, or Firm* — Mark W Handley

(57) ABSTRACT

A composite frac plug (12) is formed of composite polymer materials, except for shear pins (52) and anchor cleats (96, 112) which are formed of metal. The frac plug (12) has an elastomeric ball seat (44) which sealing engages with a frac ball (18). A ratchet lock assembly (26) has a split ratchet ring (82) which moves over the mandrel (22) in a downward direction only, and prevents movement of the mandrel (22) downward within the ratchet ring (92). An anchor assembly (28) has slip bodies (92, 108) which are segmented and separately urge anchor cleats (96, 112) into the interior surface of a well casing (136).

20 Claims, 8 Drawing Sheets

COMPOSITE SLIPS FOR A FRAC PLUG

CROSS-REFERENCE TO RELATED APPLICATION

The present application is a continuation of U.S. Pat. No. 8,887,818, issued Nov. 18, 2014, assigned application Ser. No. 13/288,014 and filed Nov. 2, 2011, and application Ser. No. 14/537,865 and filed Nov. 10, 2014, with both invented by Jimmy L. Carr, Derrek D. Drury, Robert C. Andres, and Trea H. Baker, and assigned to Diamondback Industries, Inc., the assignee of the present application.

TECHNICAL FIELD OF THE INVENTION

The present invention is related to downhole oil tools, and in particular to frac plugs, bridge plugs and packers for sealing well casing.

BACKGROUND OF THE INVENTION

In drilling oil and gas wells, it is common to run casing into a wellbore and cement the casing in place. Often, in shale formations fracturing is required to produce fluids in oil and gas bearing formations. Enabled fracturing of desired formations, frac plugs and bridge plugs are set in place on opposite sides of the formation being treated. Fluids are then pumped into the wellbore and out into the formation at high pressures to fracture formations. Prior art frac plugs, bridge plugs and packers have been formed of cast iron and other easily drillable materials so that they may be more easily drilled than if formed of steel. To further enhance the ease in which frac plugs, bridge plugs and packers may be drilled, they have made with composite materials formed of plastic rather than metal. Use of composite materials to replace cast iron and other metal components for frac plugs, bridge plugs and packers has resulted in reduced reliability and reduced operating performance parameters. Improvements in reliability and operating performance parameters are desired.

SUMMARY OF THE INVENTION

A composite frac plug is provided which is formed of composite materials, except for shear pins and anchor cleats which are formed of metal. The composite materials provide for easy drilling of the frac plug at the end of fracturing operations. The frac plug has an elastomeric ball seat which sealing engages with a frac ball. A ratchet lock assembly is formed of composite materials and has a split ratchet ring which moves over a tool mandrel in a downward direction only, and prevents movement of the tool mandrel downward within the ratchet ring. An anchor assembly has a conical sleeves and slip bodies formed of composite materials, and anchor cleats formed of metal. The slip bodies are segmented and separate into slip segments when urging anchor cleats into the interior surface of a well casing.

DESCRIPTION OF THE DRAWINGS

For a more complete understanding of the present invention and the advantages thereof, reference is now made to the following description taken in conjunction with the accompanying Drawings in which

FIG. 1 is a one-quarter longitudinal section view of a tool string having a frac plug made according to the present invention;

FIG. 2 is a one-quarter longitudinal section view of the frac plug of the present invention shown in a run-in position;

FIG. 3 is perspective view of a plurality of anchor cleats used for securing the frac plug within casing;

FIG. 4 is one-quarter longitudinal section view of a segmented slip body for use in the frac plug;

FIG. 5 is a longitudinal section view of the frac plug shown in a set position within casing;

FIG. 6 is a one-quarter longitudinal section view of the frac plug of FIG. 2, enlarged to show a rachet lock assembly;

FIG. 7 is a side view of the frac plug FIG. 2, enlarged to show a seal assembly;

FIG. 8 is a one-quarter longitudinal section view of a bridge plug made according to the present invention; and FIG. 9 is a one-quarter longitudinal section view of a packer and a stinger for use with the packer according to the present invention.

DETAILED DESCRIPTION OF THE INVENTION

Figure 1:
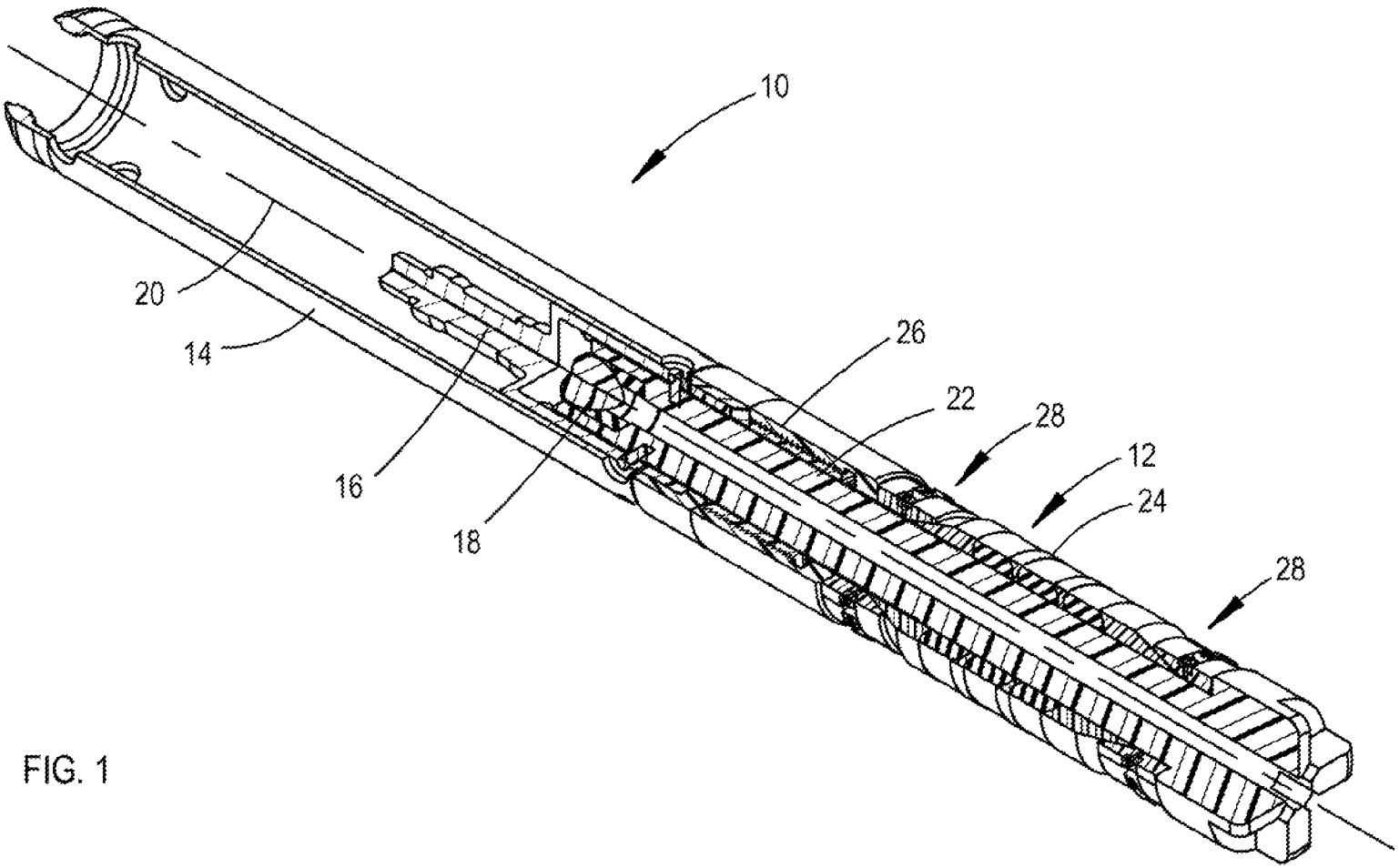
FIGS. 1 through 9 show various aspects for composite frac plug devices made according to the present invention, as set forth below.

FIG. 1 is a one-quarter longitudinal section view of a portion of a tool string 10 which includes a frac plug 12 made according to the present invention, shown in a run-in position. Also shown is a setting sleeve 14 and a mandrel adapter 16 which is mounted atop of the frac plug 12. A frac ball 18 is also shown, although it would typically not be included in the frac plug 12 when run into a well. The frac plug's primary components include a mandrel 22, a seal assembly 24, a ratchet lock assembly 26 and an anchor assembly 28. The tool string 10 and the frac plug 12 are symmetrically disposed about a longitudinal axis 20.

Figure 2:
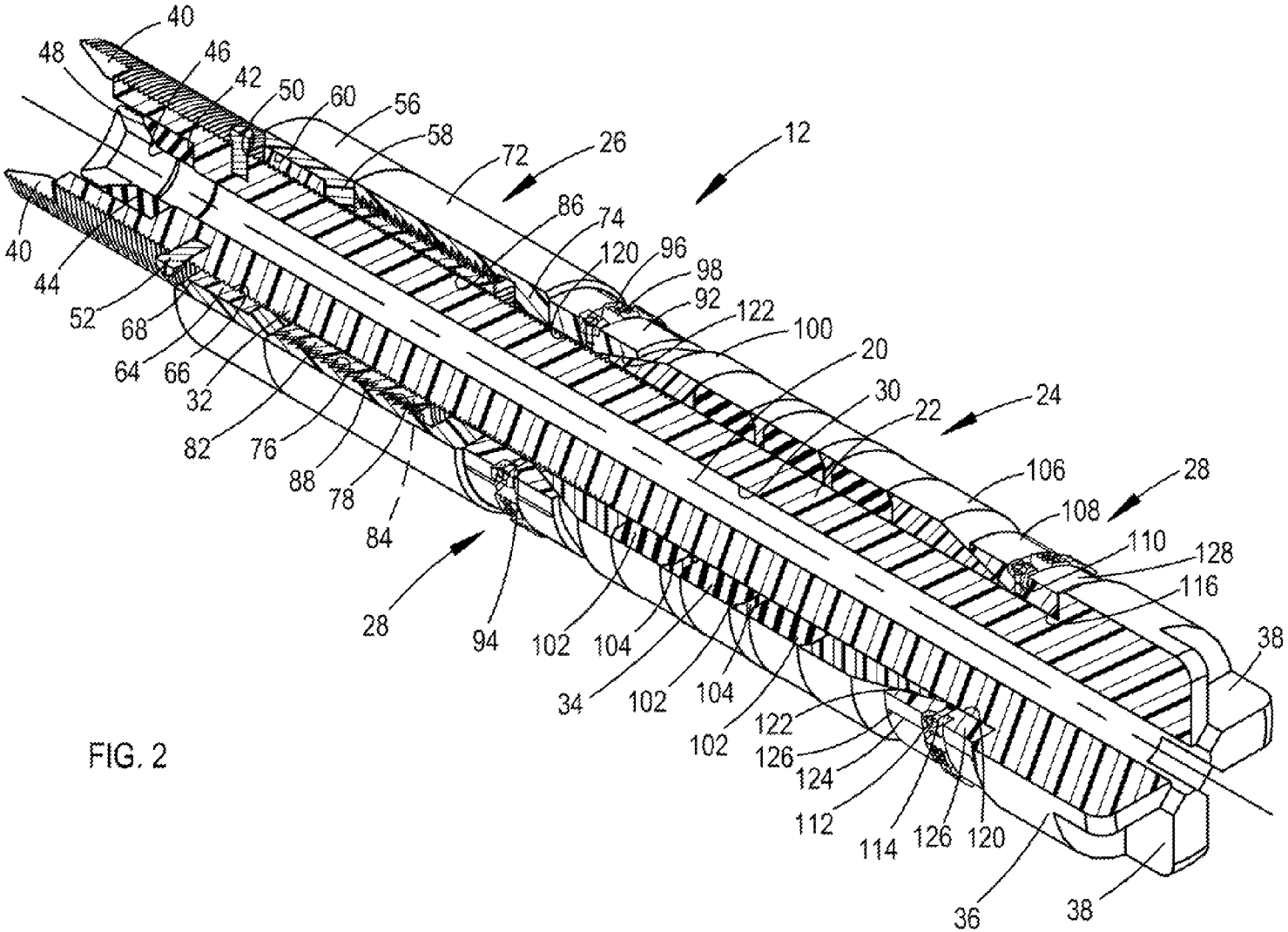

FIG. 2 is a one-quarter longitudinal section view of the frac plug 12 shown in the run-in position. The mandrel 22 has a mandrel bore 30 running the full length thereof. An upper end 32 of the exterior surface of the mandrel 22 is threaded, and an intermediate portion 34 of the mandrel 22 is smooth. A lower end 36 of the mandrel 22 is larger than the intermediate portion 34 and the threaded upper end 32. Four laterally extending tabs 38 extending longitudinally downward and laterally outward on the lowermost terminal end of the mandrel 22. Four slots 40 are formed in the upper terminal end of the mandrel 22, and are configured for registering with and receiving the tabs 38 of a mandrel 22 of a second frac plug set in a well casing above frac plug 12, such that the two frac plugs will lock together and one will not rotate on top of the other, allowing the upper frac plug to be more easily drilled should it fall on top of the bridge plug 12 when being drilled out. Located adjacent the mandrel bore 30 in the upper end of the mandrel 22 is a seat pocket 42, preferably defined as a cylindrical recess larger in diameter than the diameter of the mandrel bore 30. The seat pocket 42 is provided for receiving a ball seat 44. The ball seat 44 is preferably made of an elastomeric materials for sealingly engaging the frac ball 18. The ball seat 44 has a central bore 46 which is preferably slightly larger than the mandrel bore 30. The uppermost end of the central bore 46 has a chamfered surface 48. The ball seat 44 is preferably formed of Viton® (a registered trademark of DuPont Performance Elastomers L.L.C.) or AFLAS® (a registered trademark of Asahi Glass Company, Limited, a corporation of Japan, with the material available from Parker Hannifin Corporation). The ball seat 44 is provided for receiving the frac ball 18 and sealingly engages the chamfered surface 48 against the frac ball 18.

Extending into the exterior surface of the upper end of the mandrel 22 are preferably eight shear pin holes 50. Shear pins 52 extend into and are secured within the shear pin holes 50 in the mandrel 22. The shear pins 52 secure the mandrel adapter 16 to the upper end of the mandrel 22 to allow run-in and setting of the frac plug 12. The shear pins 52 may be threadingly secured, secured by means of adhesives, or sonically welded to mandrel 22. Preferably, the mandrel adapter 16 is removed from the well with the setting tool after the frac plug 12 is set within casing. The mandrel adapter 16 and the setting sleeve 14 are preferably formed of steel. The mandrel 22 is formed of either a composite polymer plastic materials, or composed fully of a polymer plastic materials. In the current embodiment, the mandrel 22 is formed of polyamide plastics. Composite materials used to form the various components of the frac plug 12 may be fiber wound, such as using glass or carbon fibers, or impregnated with particles of various sizes, including glass particles, carbon particles, or micro-particles of various materials. Preferably the eight shear pins 52 are provided by brass shear screws which are easily drilled and are rated at a tensile strength of 3,750 pounds each. The shear pins 52 are sheared when the frac plug 12 is set, releasing the mandrel adapter 16 for removal form the mandrel 22 of the frac plug 12.

A lock ring sleeve 56 is shown disposed adjacent to the threaded upper end 32 of the mandrel 22, in proximity to the shear pin holes 50, and spaced beneath the shear pin holes 50. The lock ring sleeve 56 has an L-shaped cross-section defined in part by an annular shaped tab 58 which extends downward and inward to define an annular space 60 with an open upper end and a closed lower end. The annular space 60 extends between the inner surface of the lock ring sleeve 56 and the upper threaded end 32 of the mandrel 22. Preferably, the interior surface of the annular shaped tab 58 of the lock ring sleeve 56 has a smooth interior surface which is disposed adjacent to the threaded upper end 32 of the mandrel 22. The interior surface of the tab 58 is smooth for sliding downward over the threaded upper end 32 of the mandrel 22. A lock ring 64 is annular shaped and has a threaded bore 66 with the smooth exterior surface 68. Threaded bore 66 is of a similar thread to that of the threaded upper end 32 of the mandrel 22 for threadingly securing the lock ring 64 in a desired position along the longitudinal length of the mandrel 22.

A ratchet sleeve 72 is shown adjacent to the lowermost end of the lock ring sleeve 56, and has a cylindrically shaped exterior surface and an L-shaped cross-section. The lowermost end of the ratchet sleeve 72 has an inwardly protruding annular shaped tab 74, similar to that of the lock ring sleeve 56. The annular shaped tab 74 defines an annular shaped recess 76 with an open upper end for receiving a ratchet ring 82. The ratchet sleeve 72 has a threaded interior surface 78 for engaging a ratchet ring 82.

The ratchet ring 82 is preferably a split ring having a longitudinally extending slot 84 (shown in FIG. 6) which extends completely through a sidewall of the ratchet ring 82, preferably parallel to the longitudinal axis 20. The longitudinally extending slot 84 extends the full length of and through the sidewall to allow the ratchet ring 82 to expand and open. The ratchet ring has an inner threaded surface 86 and an outer threaded surface 88, with the threaded surface 86 having finer threads, with a higher pitch, as compared to the course threads of the outer threaded surface 88. The ratchet ring 82 is urged to open by engagement of the fine threads of the upper threaded surface 86 on the threaded upper end 32 of the mandrel 22. The fine threads of the inner threaded surface 86 threadingly engage the threads of the threaded upper end 32 of the mandrel 22, such that the mandrel 22 will move upward in relation to the ratchet ring 82, having a cam type engagement between the threads which urges expansion of the ratchet ring 82 when the mandrel 22 is being urged to move upward within the ratchet ring 82. The mating fine threads are also formed such that the ratchet ring 82 will not open in response to the mandrel being moved downward within the ratchet ring 82.

The outer threads on the outer threaded surface 88 of the ratchet ring 82 have a top portion at a substantially ninety degree angle to the longitudinal axis 20, and a lower surface which is at approximately a forty-five degree angle to approximately a thirty degree angle to the longitudinal axis 20. Configuration of the threads on the inner threaded surface 86 and the outer threaded surface 88 are such that when they work in conjunction, the mandrel 22 may move upward relative to the ratchet ring 82, but not downwards. The course threads mating between the ratchet ring 82 and the ratchet sleeve 72 are configured such that the split ratchet ring 82 will not expand in response to the mandrel 22 moving downward within the ratchet ring 82, but the ratchet ring 82 will expand as the ratchet ring 82 moves downward over the mandrel 22. This avoids downward creep of the mandrel 22 due to high pressure being are applied to the top of the frac plug 12 during use. Should there still be some slippage caused by expansion of the thermoplastic materials used in the components of the frac plug 12, the lock ring 64 acts as a secondary lock should any slippage occur of the mandrel 22 downward within the ratchet ring 82, such that the seal assembly 24 will remain firmly secured within the casing.

The seal assembly 24 includes an upper slip body 92 which has an upper end defining a shoulder which disposed adjacent a lower end of the ratchet sleeve 72. A groove 94 extends around a circumference of an upper slip body 92 for receiving anchor cleats 96 and fasteners 98 for securing the anchor cleats 96 in spaced apart relation within the groove 94. An upper conically shaped sleeve 100 is disposed adjacent the lower end of the upper slip body 92. The upper conical sleeve 100 is disposed adjacent one of the spacer rings 105, with the spacer ring 105 disposed adjacent to the uppermost one of the packer elements 102. The packer elements 102 are preferably provided by elastomeric materials. Spacer rings 104 are disposed between the three packer elements 102. A second spacer ring 105 is disposed between the packer elements 102 and the lower conical sleeve 106. Preferably, a central one of the packer elements 102 will be of a different material than the upper and lower packer elements 102, preferably having a lesser hardness than the upper and lower packer elements 102. A lower conical sleeve 106 is disposed immediately beneath the second spacer ring 105. The spacer rings 104 and 105 are provided to allow release of the packer elements 102 from sealingly engaging a well casing. A slip body 108 is disposed adjacent the lower end of the lower conical sleeve 106. A groove 110 circumferentially extends around and into the lower slip body 108 for receiving anchor cleats 112. Fasteners 114 secure the anchor cleats 112 into the upper slip body 92 and the lower slip body 108. A lowermost end of the lower conical sleeve 106 engages against a shoulder 116 portion of the lower end 36 of the mandrel 22.

Figure 3:
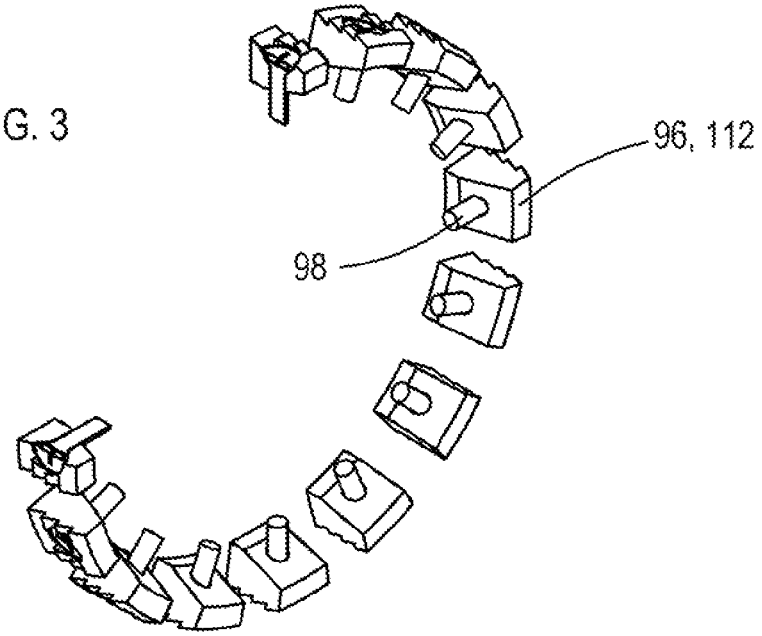
Figure 4:
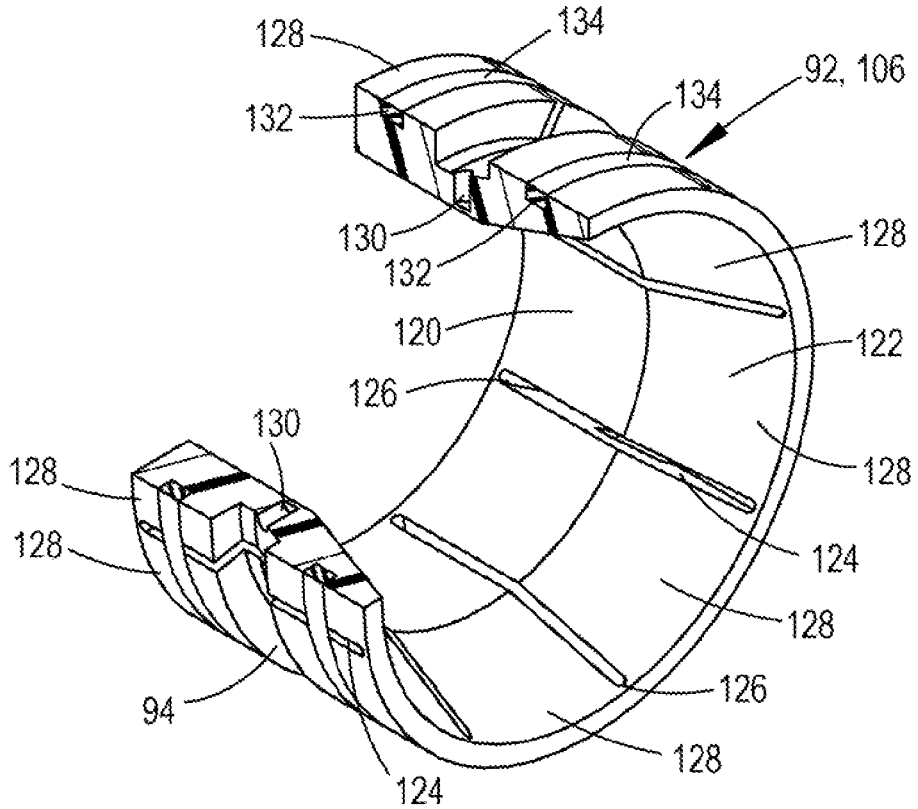

FIG. 3 is perspective view of a portion of the anchor cleats 96 and fasteners 98 secured to one of the upper slip body 92 and the lower slip body 108. The anchor cleats 96 are preferably formed of a case hardened cast iron. FIG. 4 is one-quarter longitudinal section view of the upper slip body 92, which is of the same shape as the lower slip body 108 except oriented in a different direction. Slip bodies 92 and 106 have smooth bores, and inward end surfaces which define conically-shaped interior recesses 122. The sip bodies 92 and 108 are segmented by elongated slots 124 which extend longitudinally into the slip bodies 92 and 108. The slots 124 extend from an interior surface to an exterior surface of the slip bodies 92 and 108, and have shear portions 126 defined on opposite terminal ends of elongate slots 124. The slots 124 are angularly spaced about a central longitudinal axis 20 to define eight separate slip segments 128, with each of the slip segments 128 preferably having two of the anchor cleats 96. Holes 130 extend radially into the bottom of the groove 94 for securing the fasteners 98 therein to secure the anchor cleats 112 within the grooves 94. Fasteners 98 may be threaded, secured with an adhesive, or sonically welded into holes 130. Two grooves 132 extend circumferentially around the exterior of each of the slip bodies 92 and 108 for receiving elastomeric retention bands 134 which retain the slip segments 128 against the mandrel 22 should the shear portions 126 separate prior to setting the frac plug 12. (Grooves 132 and bands 134 are shown in FIG. 4 only).

Figure 5:
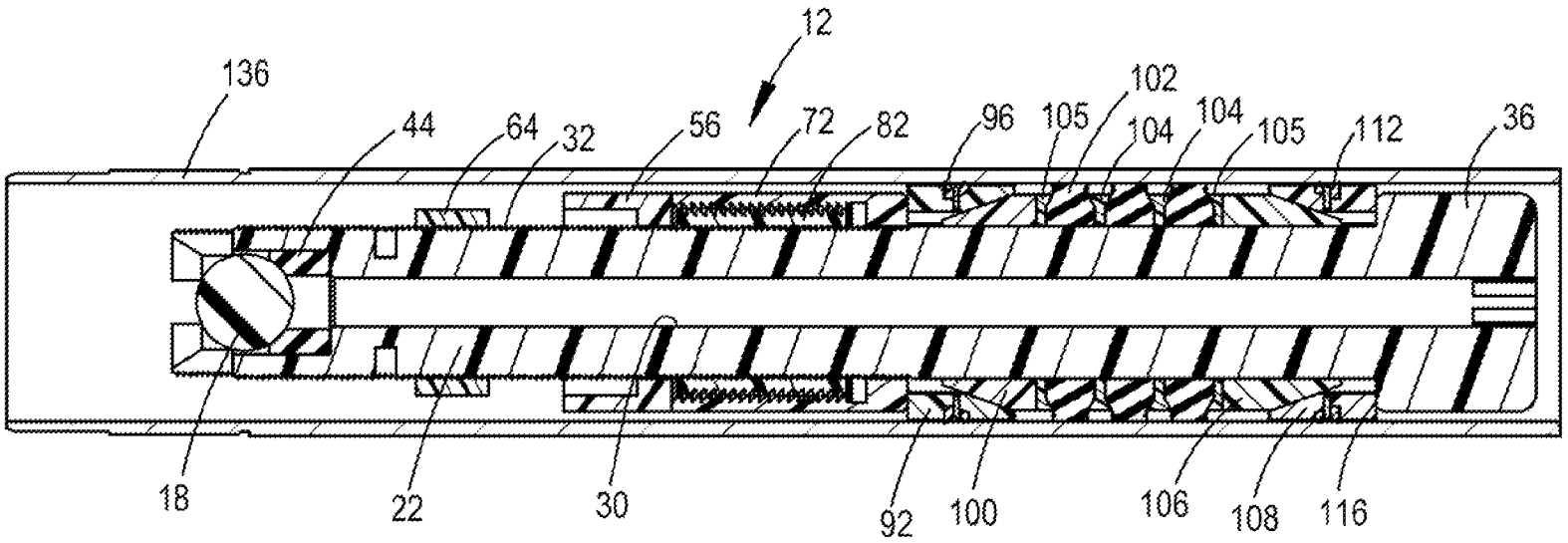

FIG. 5 is a longitudinal section view of the frac plug 12 shown in a set position within a casing 136. The frac ball 18 is shown disposed in the upper end of mandrel 22, engaging with the ball seat 44 to seal the upper end of the frac plug 12 that has been set by holding the mandrel 22 stationary and pushing downward with the setting sleeve 14 to move the ratchet ring 82 and the ratchet sleeve 72 downward over the mandrel 22. The lower end of the ratchet sleeve 72 will push the slip body 92 onto the upper conical sleeve 100 and will squeeze the packer elements 102 to engage between the exterior surface of the mandrel 22 and an interior surface of the casing 136. Pushing the conical sleeve 100 downward also pushes the lower conical sleeve 106 against the lower slip body 108, which pushes the lower slip body 108 outward and against the shoulder 116 on the lower end 36 of the mandrel 22, which is held stationary. Shaped surfaces of the upper conical sleeve 100 and the lower conical sleeve 106 engage the conical-shaped recesses 122 of the upper slip body 92 and the lower slip body 108, pushing the slip bodies 92 and 108 outward, separating the shear portions 126 and breaking the slip bodies 92 and 106 into the segments 128. The segments 128 are pushed outwards to press the anchor cleats 96, 112 into the casing 136 to lock the frac plug 12 in position within the casing 136.

Figure 6:
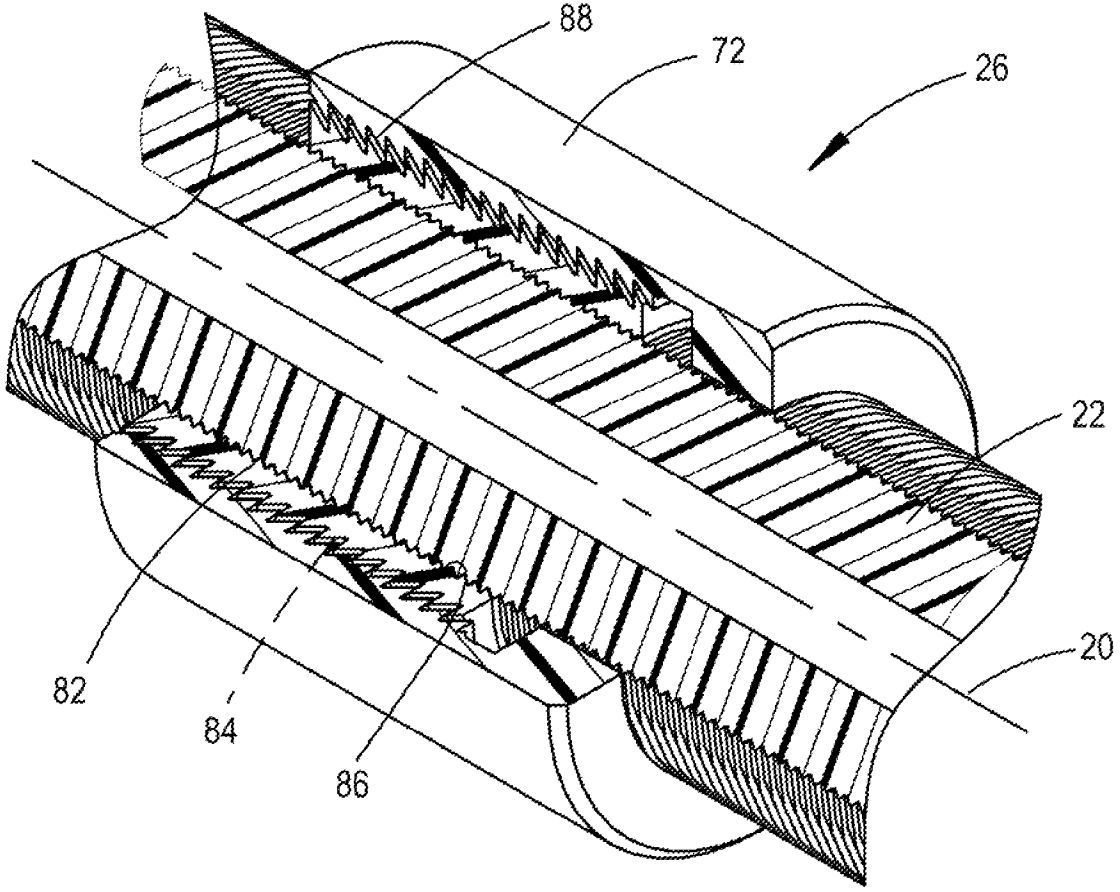

FIG. 6 is a one-quarter longitudinal section view of the rachet lock assembly 26 showing a partial view of the mandrel 22, the split ratchet ring 82 and the rachet sleeve 72.

Figure 7:
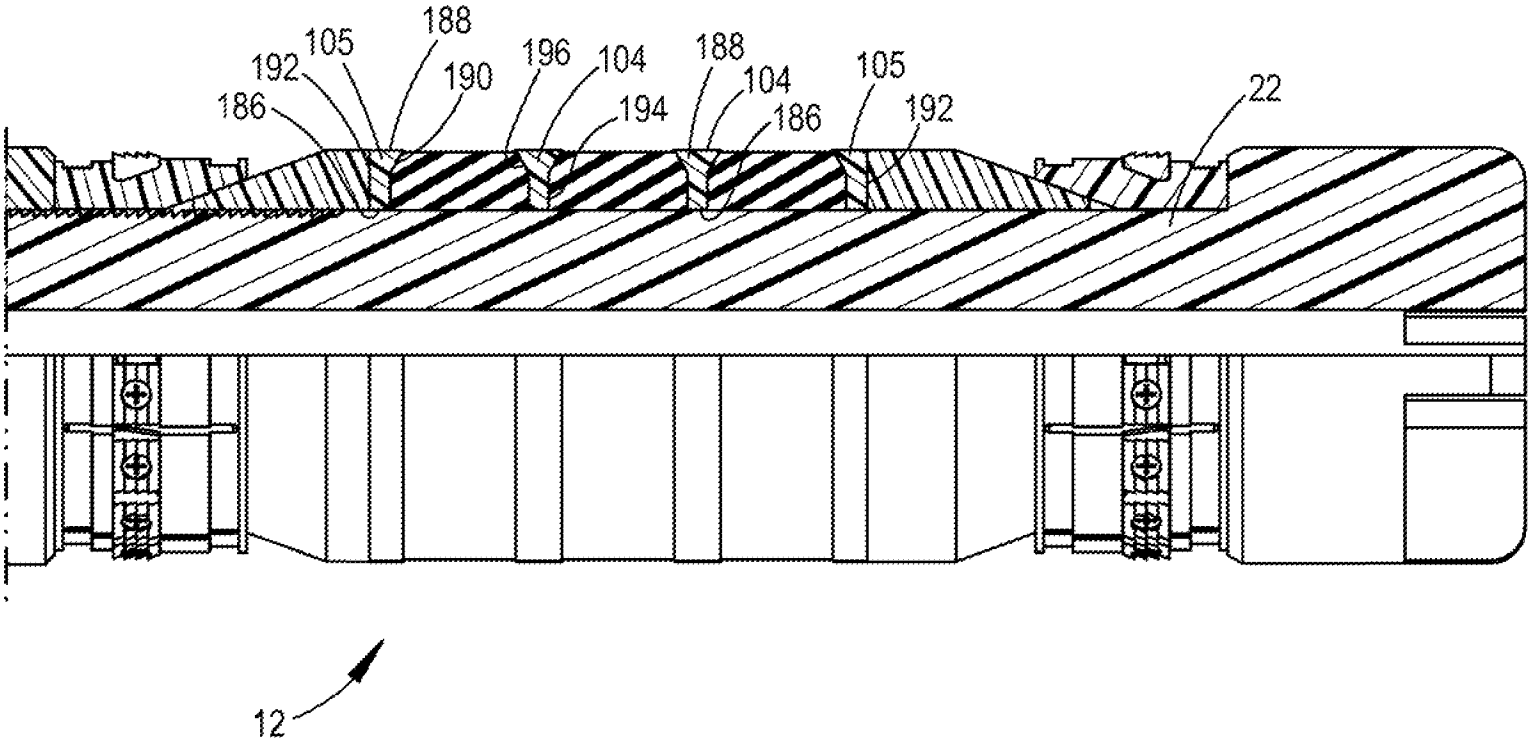

FIG. 7 is a side view of the anchor assembly shown in FIG. 2 show in a run-in position, and shows the spacer rings 105 disposed between the conical sleeves 100 and 106 and the packer elements 102, and the spacer rings 104 disposed between the packer elements 102. The spacer rings 104 and 105 have inner surfaces 186 which slidingly engage against the mandrel 22, and outer surfaces 188 which space apart outer edges of the packer elements 102. The outer surfaces 188 are preferably slightly larger in diameter than the packer elements 102 during run-in. The spacer rings 104 and 105 further have annular-shaped sidewalls 190 and 192 which extend between the inner surfaces 186 and the outer surfaces 188. The annular-shaped sidewalls 192 are provided on one side of each of the spacer rings 105, and are flat, preferably perpendicular to the longitudinal axis 20 of the frac plug 12. The sidewalls 192 engage against sidewalls of the conical sleeves 100 and 106. The annular-shaped sidewalls 190 of the spacer rings 104 and 105 are disposed directly against the packer elements 120, and are provided on two sides of each of the spacer rings 104 and on one side of the spacer rings 105. The sidewalls 190 have inward portions 194 which are preferably perpendicular to a longitudinal axis 20 for the frac plug 12, and outward portions 196 which are outwardly tapered such that outer portions 196 extend toward adjacent ones of the packer elements 102 for guiding the packer elements 120 in a direction away from the sidewalls 190 during setting. The outward portions 196 preferably extend in a radial direction, that is, with a radial component which is orthogonal to the longitudinal axis 20, for a distance of approximately thirty percent to forty percent of the radial thickness of the sidewalls 190.

Figure 8:
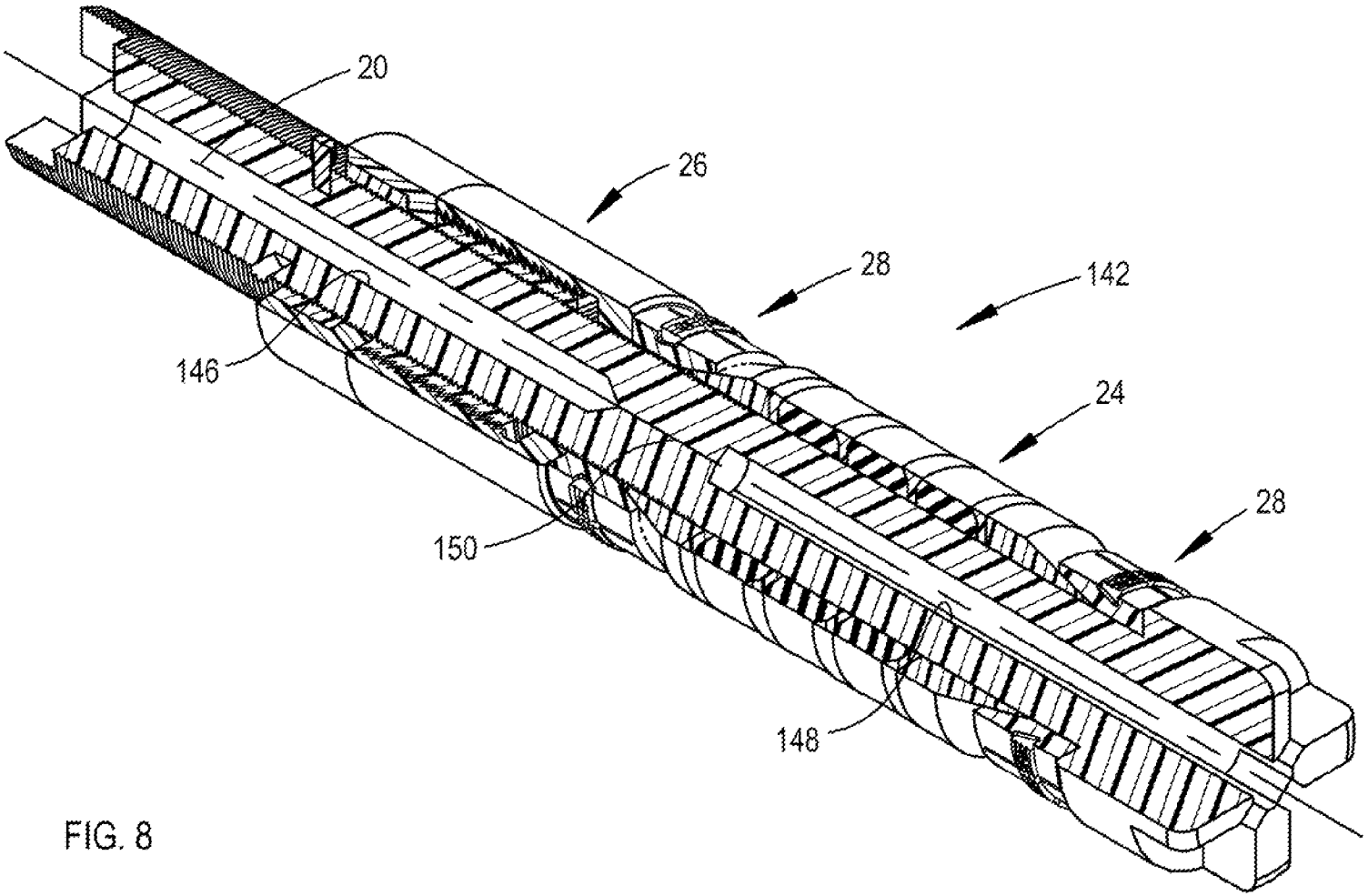

It should be noted that the above-described components of the frac plug 12 may be used in configurations providing other downhole tools formed of composite polymeric materials, such as a bridge plugs and packers. FIG. 8 a one-quarter longitudinal section view of a bridge plug 142 made of composite materials according to the present invention for sealing well casing. The bridge plug 142 is formed of like components to the frac plug 12 discussed above, except that the bridge plug 142 includes a mandrel 144 rather then the mandrel 22 of the frac plug 12. The mandrel 22 has an upper bore 146 formed as a blind hole, a lower bore 148 also formed as a blind hole, a solid section formed between inward terminal ends of the upper bore 146 and the lower bore 148.

Figure 9:
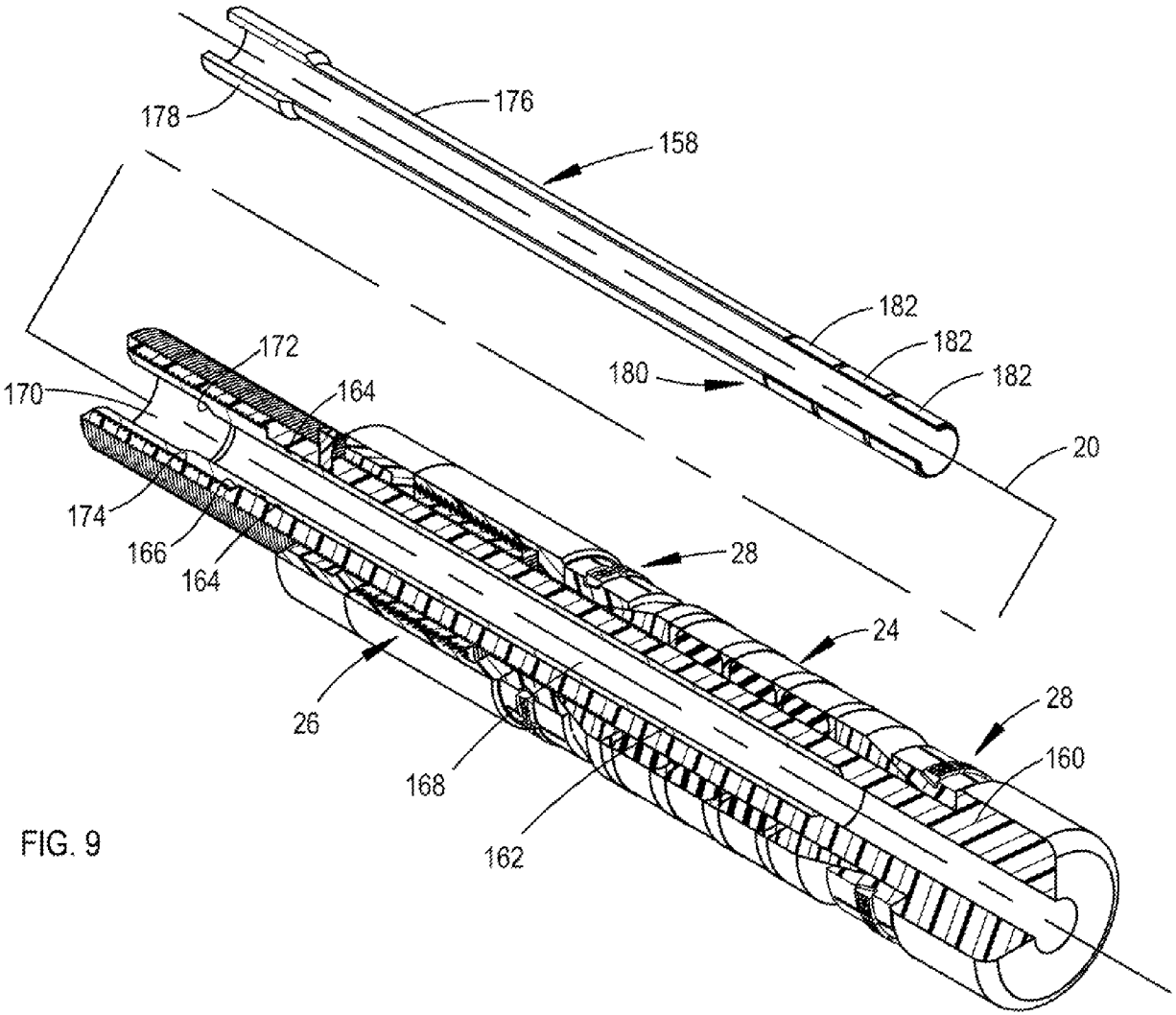

FIG. 9 is a one-quarter longitudinal section view of a packer 156 and a stinger 158 formed of composite plastic materials according to the present invention for sealing well casing. The packer 156 uses like components to the components of the frac plug 12 and the bridge plug 142. The packer 156 has mandrel 160 which differs from the mandrels 22 and 144. A receptacle sleeve 162 which is preferably formed of aluminum fits within a bore extending through the packer 156. The sleeve 162 extends through a terminal end of mandrel 22 and has seals 164 provided by two O'rings which seal between the mandrel 160 and the sleeve 162. The sleeve 162 has an enlarged upper end defining a shoulder 162 for engaging a stop shoulder in the bore of the frac plug 10. The lower bore 168 is polished for sealingly engaging with the stinger 158. An enlarged end bore 170 is provided on an upper terminal end of the mandrel 160, and a tapered section 172 extends between the bore 170 and the polished bore 168. Threaded sections 174 secure the receptacle sleeve 162 within the mandrel 160. The stinger 158 is provided by a tubular member 176 having an upwardly disposed connector end 178 for machining to secure to a drill collar fitting of a tool string. A lower end 180 has seals 182, which are preferably provided by three separate seal stacks composed of chevron-shaped seal elements. The stinger 158 fits within the receptacle sleeve 162 to sealingly engage the seals 182 with the polished bore 168.

The present invention provides downhole tools formed of composite polymeric materials for sealing well casing, such as frac plugs, bridge plugs and packers, with the only metal parts being brass shear screws which secure such tools to adapter heads and setting tools, anchor cleats which are made from case hardened cast iron for anchoring the downhole tools within well casing, and an aluminum sleeve insert which is polished to provide a polished bore to seal against. The composite materials provide for easy drilling of the downhole tools, as compared to drilling prior art cast iron frac plugs, bridge plugs and packers. An elastomeric ball seat is further provided, allowing for sealing engagement with the frac ball and ease of drilling as compared to prior art polished metal ball seats. A ratchet lock assembly provides for movement of a split ratchet ring over the mandrel in a downward direction, but prevents movement of the mandrel downward within the ratchet ring. Further, an anchor assembly provides slip bodies are segmented for separating into slip segments which are pushed outward from a tool mandrel for urging anchor cleats into the interior surface of a well casing. The tool mandrels, ratchet lock and anchor assembly are formed of composite plastic materials, except for the anchor cleats mounted to the slip segments.

Although the preferred embodiment has been described in detail, it should be understood that various changes, substitutions and alterations can be made therein without departing from the spirit and scope of the invention as defined by the appended claims.

What is claimed is:

1. A downhole tool for sealing a well casing comprising:

a mandrel defining a longitudinal axis for said downhole tool, said mandrel having an upper portion and a lower end, said lower end of said mandrel having a larger diameter than said upper portion of said mandrel;

a seal assembly having at least one elastomeric packer element which is squeezed when said downhole tool is set to sealingly engage between said mandrel and said well casing;

a conically shaped surface disposed about said mandrel and on one side of said seal assembly;

at least one slip body disposed adjacent said conically shaped surface;

said at least one slip body having an annular shaped groove formed into an exterior surface thereof for receiving a plurality of independently securable anchor cleats which are secured by fasteners within said groove and disposed in spaced apart relation, extending about a longitudinal axis of said mandrel, and said fasteners securing said plurality of anchor cleats within said at least one slip body; and wherein said downhole tool is moved to a set position by moving said at least one slip body to move outward and upon said conically shaped surface of said downhole tool.

2. A downhole tool according to claim 1, wherein said at least one slip body has an interior bore, a conically-shaped interior recess in one end, and a plurality of slots extending longitudinally into said at least one slip body, said slots being spaced apart in angular alignments about said longitudinal axis to define shear portions disposed adjacent opposite ends to the elongate slots and to define slip segments disposed between said shear portions; and wherein said at least one slip body is formed of composite materials.

3. The downhole according to claim 2, wherein said at least one slip body has at least one circumferentially extending groove extending into exterior surfaces thereof for receiving an elastomeric band for retaining said slip segments against said mandrel during run-in.

4. The downhole tool according to claim 1, further comprising:

said mandrel having a mandrel bore continuously extending through said mandrel for passing fluids through said mandrel bore;

a ball seat pocket formed into an uppermost end of said mandrel, adjacent said mandrel bore; and a ball seat disposed in said ball seat pocket, said ball seat having a central bore and an upwardly facing surface defined adjacent to said central bore for receiving a frac ball and sealingly engaged against said frac ball, wherein said ball seat is formed of elastomeric materials.

5. The downhole tool according to claim 1, further comprising:

said mandrel having a mandrel bore continuously extending through said mandrel for passing fluids through said mandrel bore; and said mandrel bore having a polished bore for sealingly engaging with a seal assembly of a tubular member inserted through an upper end of said mandrel.

6. The downhole tool according to claim 5, wherein said mandrel further comprises a receptacle sleeve disposed within said mandrel and at least in part defining said mandrel bore, said receptacle sleeve being polished to define said polished bore.

7. The downhole tool according to claim 5, wherein said mandrel bore comprises a blind hole and said downhole tool defines a bridge plug.

8. The downhole tool according to claim 1, further comprising:

a lock ring threadingly secured to said mandrel, said lock ring having an annular-shaped body which extends circumferentially about said mandrel; and a lock ring sleeve disposed circumferentially around and projecting beneath said lock ring.

9. A downhole tool for sealing a well casing comprising:

a mandrel defining a longitudinal axis for said downhole tool, said mandrel having an upper portion and a lower end, said lower end of said mandrel having a larger diameter than said upper portion of said mandrel;

a seal assembly having at least one elastomeric packer element which is squeezed when said downhole tool is set to sealingly engage between said mandrel and casing;

a conically shaped surface disposed about said mandrel on one side of said seal assembly;

a slip body formed of composite materials and disposed around said mandrel, said slip body having an annular shaped groove formed into an exterior surface thereof for receiving a plurality of independently securable anchor cleats which are secured by fasteners within said groove and disposed in spaced apart relation, extending about said longitudinal axis of said mandrel, and said fasteners securing said anchor cleats within said groove in said slip body; and wherein said downhole tool is moved to a set position by moving said slip body to move outward and upon a conically shaped surface of said downhole tool.

10. The downhole tool according to claim 9, wherein said slip body an interior bore, a conically-shaped interior recess in one end, and a plurality of slots extending longitudinally into respective bodies of said slip bodies, said slots being spaced apart in angular alignments about said longitudinal axis to define shear portions disposed adjacent opposite ends to the elongate slots and to define slip segments disposed between said shear portions.

11. The downhole according to claim 10, wherein said slip body has at least one circumferentially extending groove extending into exterior surfaces thereof for receiving an elastomeric band for retaining said slip segments against said mandrel during run-in.

12. The downhole tool according to claim 9, further comprising:

a mandrel bore continuously extending through said mandrel for passing fluids through said mandrel bore;

a ball seat pocket formed into an uppermost end of said mandrel, adjacent said mandrel bore; and a ball seat disposed in said ball seat pocket, said ball seat having a central bore and an upwardly facing surface defined adjacent to said central bore for receiving a frac ball and sealingly engaged against said frac ball, wherein said ball seat is formed of elastomeric materials.

13. The downhole tool according to claim 9, further comprising:

a mandrel bore continuously extending through said mandrel for passing fluids through said mandrel bore; and said mandrel bore having a polished bore for sealingly engaging with a seal assembly of a tubular member inserted through an upper end of said mandrel.

14. The downhole tool according to claim 13, wherein said mandrel further comprises a receptacle sleeve disposed within said mandrel and at least in part defining said mandrel bore, said receptacle sleeve being polished to define said polished bore.

15. The downhole tool according to claim 9, wherein said mandrel bore comprises a blind hole and said downhole tool defines a bridge plug.

16. The downhole tool according to claim 9, further comprising:

a lock ring threadingly secured to said mandrel, said lock ring having an annular-shaped body which extends circumferentially about said mandrel; and a lock ring sleeve disposed circumferentially around and projecting beneath said lock ring.

17. A downhole tool for sealing a well casing comprising:

a mandrel formed of composite material defining a longitudinal axis for said downhole tool, said mandrel extending longitudinally about said longitudinal axis, having an exteriorly threaded upper portion, a smooth intermediate portion and a lower end, said lower end of said mandrel having a larger diameter than said upper portion and said intermediate portion;

a lock ring formed of composite materials which is threadingly secured to said mandrel, said lock ring having an annular-shaped body which extends circumferentially about said mandrel;

a lock ring sleeve formed of composite materials, said lock ring sleeve disposed circumferentially around and projecting beneath said lock ring;

a seal assembly having at least one elastomeric packer element which is squeezed when said downhole tool is set to sealingly engage between said mandrel and casing;

conically shaped surfaces disposed about said mandrel on opposite sides of said seal assembly;

an upper slip body and a lower slip body, each formed of composite materials and disposed around said mandrel, adjacent to respective ones of said conically shaped surfaces, and spaced apart along said longitudinal axis on opposite respective sides of said seal assembly;

a plurality of anchor cleats, wherein each of said anchor cleats is separate from an adjacent anchor cleat;

said upper slip body and said lower slip body each having an annular shaped groove formed into an exterior surface thereof for receiving a respective portion of said plurality of anchor cleats, wherein each of said anchor cleats are separately secured to respective ones of said upper slip body and said lower slip body by a respective fastener within a respective one of said grooves and disposed in spaced apart relation, extending about said longitudinal axis of said mandrel;

said upper slip body and said lower slip body each having an interior bore, a conically-shaped interior recess in one end, and a plurality of slots extending longitudinally into respective bodies of said slip bodies, said slots being spaced apart in angular alignments about said longitudinal axis to define shear portions disposed adjacent opposite ends to the elongate slots and to define slip segments disposed between said shear portions;

wherein each of said slip segments has at least two of said plurality of anchor cleats mounted thereto in respective ones of said annular shaped grooves; and wherein said downhole tool is moved to a set position by moving said upper slip body and said lower slip body to move outward and upon respective ones of said conically shaped surfaces of said downhole tool.

18. The downhole according to claim 17, wherein said upper slip body and said lower slip body each have at least one circumferentially extending groove extending into exterior surfaces thereof for receiving an elastomeric band for retaining said slip segments against said mandrel during run-in.

19. The downhole tool according to claim 17, further comprising:

said mandrel having a mandrel bore continuously extending through said mandrel for passing fluids through said mandrel bore;

a ball seat pocket formed into an uppermost end of said mandrel, adjacent said mandrel bore; and a ball seat disposed in said ball seat pocket, said ball seat having a central bore and an upwardly facing surface defined adjacent to said central bore for receiving a frac ball and sealingly engaged against said frac ball, wherein said ball seat is formed of elastomeric materials.

20. The downhole tool according to claim 17, further comprising:

a mandrel bore continuously extending through said mandrel for passing fluids through said mandrel bore; and said mandrel bore having a polished bore for sealingly engaging with a seal assembly of a tubular member inserted through an upper end of said mandrel.

* * * * *